US010815841B2

(12) United States Patent
Nagae

(10) Patent No.: US 10,815,841 B2
(45) Date of Patent: Oct. 27, 2020

(54) VALVE DRIVE SYSTEM OF INTERNAL COMBUSTION ENGINE

(71) Applicant: TOYOTA JIDOSHA KABUSHIKI KAISHA, Toyota-shi, Aichi-ken (JP)

(72) Inventor: Masahiro Nagae, Motosu-gun (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 16/596,195

(22) Filed: Oct. 8, 2019

(65) Prior Publication Data

US 2020/0141286 A1 May 7, 2020

(30) Foreign Application Priority Data

Nov. 6, 2018 (JP) ..... 2018-208774

(51) Int. Cl.

| | |
|---|---|
| ***F01L 1/18*** | (2006.01) |
| ***F01L 1/24*** | (2006.01) |
| ***F02D 9/04*** | (2006.01) |
| ***F01L 1/047*** | (2006.01) |

(52) U.S. Cl.

CPC ..... *F01L 1/2416* (2013.01); *F01L 1/047* (2013.01); *F01L 1/181* (2013.01); *F02D 9/04* (2013.01); *F02D 2200/023* (2013.01)

(58) Field of Classification Search

CPC ..... F01L 1/2416; F01L 1/181; F01L 1/047; F01L 1/18; F01L 1/146; F01L 13/0005; F01L 13/06; F01L 13/065; F01L 13/0036; F01L 13/0219; F02D 9/04; F02D 2200/023; Y02T 10/18

USPC ..... 60/324; 123/90.15

See application file for complete search history.

(56) References Cited

U.S. PATENT DOCUMENTS

| | | | | |
|---|---|---|---|---|
| 9,650,922 | B2 * | 5/2017 | McConville | F01L 13/0005 |
| 2015/0152756 | A1 * | 6/2015 | Nakamura | F01L 13/0015 123/90.15 |
| 2016/0319706 | A1 * | 11/2016 | McConville | F01L 1/2405 |

FOREIGN PATENT DOCUMENTS

| | | |
|---|---|---|
| JP | 2006-242037 | 9/2006 |
| JP | 2007-187135 | 7/2007 |
| JP | 2009-250065 | 10/2009 |
| JP | 2012-219725 | 11/2012 |

* cited by examiner

*Primary Examiner* — Thai Ba Trieu
*Assistant Examiner* — Dapinder Singh
(74) *Attorney, Agent, or Firm* — Finnegan, Henderson, Farabow, Garrett & Dunner, LLP

(57) ABSTRACT

In a valve drive system, a rocker arm is swung by a cam. An exhaust valve abuts on a first end portion of the rocker arm. A second end portion of the rocker arm is supported by a lash adjuster. The lash adjuster includes a bottomed cylindrical body, a plunger that is contained in the body and that is biased in a direction in which the plunger abuts on the rocker arm, a pooling chamber that is formed in the plunger, a filling chamber that is formed by the plunger and a bottom surface of the body, and a valve body that blocks inflow of oil from the pooling chamber to the filling chamber when the plunger is put in the body. The oil supply to the pooling chamber is stopped when an exhaust throttle valve is closed for actuating an exhaust brake.

5 Claims, 4 Drawing Sheets

FIG. 4
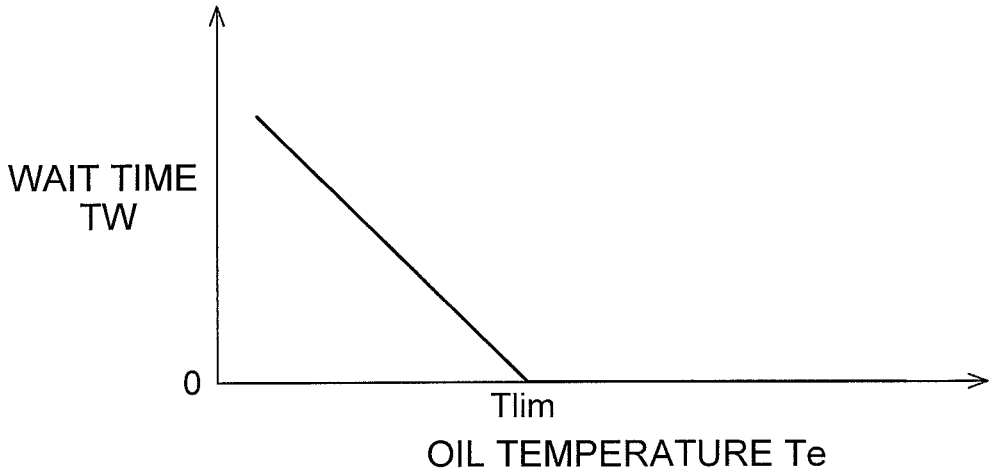
FIG. 5A
FIG. 5B
FIG. 5C
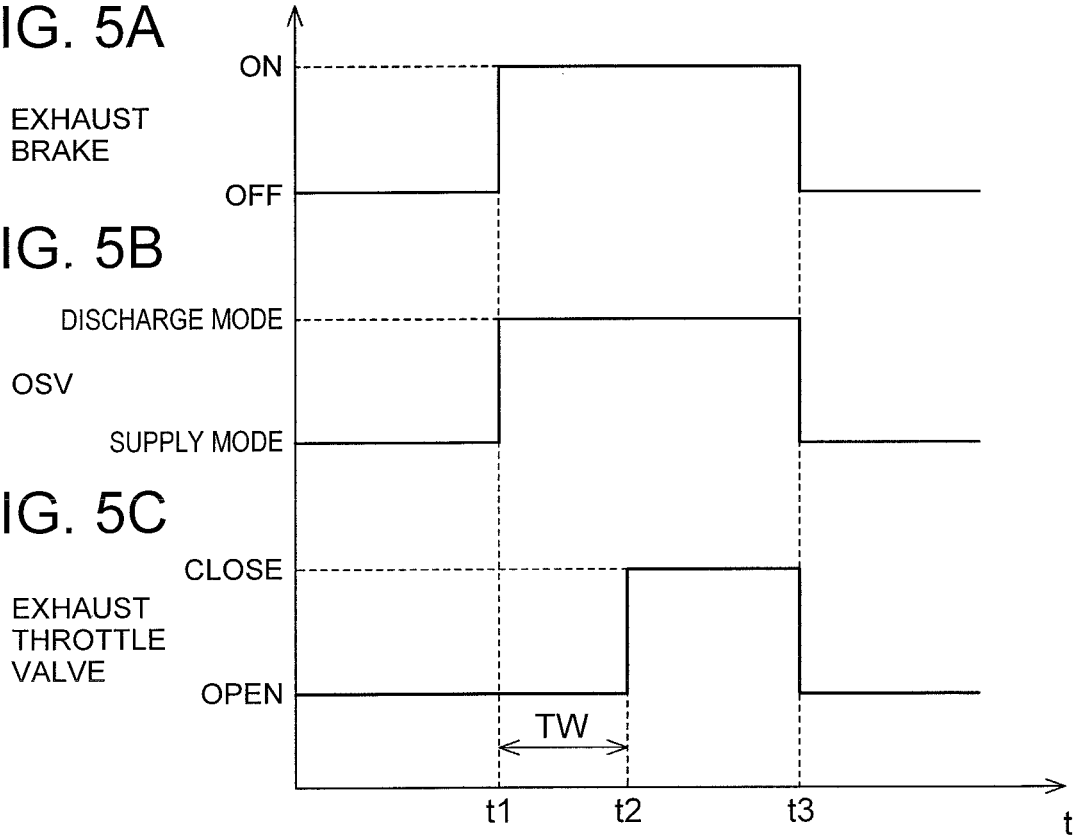

VALVE DRIVE SYSTEM OF INTERNAL COMBUSTION ENGINE

INCORPORATION BY REFERENCE

The disclosure of Japanese Patent Application No. 2018-208774 filed on Nov. 6, 2018 including the specification, drawings and abstract is incorporated herein by reference in its entirety.

BACKGROUND

1. Technical Field

The disclosure relates to a valve drive system of an internal combustion engine.

2. Description of Related Art

A valve drive device of an internal combustion engine described in Japanese Patent Application Publication No. 2007-187135 (JP 2007-187135 A) includes a rocker arm that is swung by a cam. A first end of the rocker arm is supported by a lash adjuster. On a second end of the rocker arm, an exhaust valve abuts. With rotation of the cam, the rocker arm is swung, while a portion supported by the lash adjuster is adopted as a supporting point. The exhaust valve is opened and closed by the swing of the rocker arm.

A body of the lash adjuster described in JP 2007-187135 A has a bottomed cylindrical shape. In the interior of the body, a plunger is contained. A spring is interposed between an end surface of the plunger and a bottom surface of the body. By biasing fore of the spring, the plunger is biased in a direction in which the plunger advances from the interior of the body.

In the lash adjuster described in JP 2007-187135 A, a pooling chamber and a filling chamber are formed as spaces into which oil is introduced. The pooling chamber is an internal space of the plunger. The filling chamber is a space between the bottom surface of the body and the end surface of the plunger. Further, a valve hole that provides communication between the pooling chamber and the filling chamber passes through a wall of the plunger on the bottom side of the body. Furthermore, in the filling chamber, a valve body capable of shutting the valve hole is contained. To the pooling chamber, the oil is supplied from an oil pump.

In a situation where there is a clearance between the rocker arm and the plunger of the lash adjuster, the plunger starts to advance from the interior of the body, by the biasing force of the spring. On this occasion, the volume of the filling chamber starts to increase, and as a result, the oil pressure of the filling chamber decreases. Then, when the oil pressure of the pooling chamber becomes higher than the oil pressure of the filling chamber, the valve body opens, and the oil flows from the pooling chamber into the filling chamber. Thereby, the plunger advances from the interior of the body, so that the clearance between the rocker arm and the plunger is eliminated. Thereafter, when the oil pressure of the filling chamber becomes equal to or higher than the oil pressure of the pooling chamber, the valve body shuts the valve hole.

On the other hand, when the rocker arm presses the plunger, the plunger starts to be put in the body. On this occasion, even if the volume of the filling chamber starts to decrease, the flow of the oil from the filling chamber to the pooling chamber is restricted because the valve body shuts the valve hole. Therefore, the oil filled in the filling chamber restricts the putting of the plunger into the body.

SUMMARY

In the internal combustion engine described in JP 2007-187135 A, when an exhaust throttle valve is closed for actuating an exhaust brake, the pressure within the exhaust port becomes high, and the exhaust valve sometimes opens unintentionally. When the exhaust valve opens in this way, the rocker arm tilts such that a first end portion of the rocker arm departs from the lash adjuster. When the rocker arm is away from the lash adjuster, the plunger, in the lash adjuster, advances with the tilting of the rocker arm. When the plunger advances once, the putting-in of the plunger is restricted by the oil filled in the filling chamber, and therefore, even if the exhaust throttle valve is opened after that, the plunger is not immediately put in. Therefore, even after the exhaust throttle valve is opened, the rocker arm continues to tilt, so that it is not possible to appropriately open and close the exhaust valve.

For solving the problem, the present disclosure is a valve drive system of an internal combustion engine, including: a rocker arm that is swung by a cam; an exhaust valve that abuts on a first end portion of the rocker arm and that is opened and closed by the rocker arm; a lash adjuster that supports a second end portion of the rocker arm; an oil supply mechanism that supplies oil to the lash adjuster; and a control unit that controls an exhaust throttle valve and that controls the oil supply mechanism, the exhaust throttle valve changing a flow passage cross-section area of an exhaust pipe of the internal combustion engine. The lash adjuster includes: a bottomed cylindrical body; a plunger that is contained in the body and that is biased in a direction in which the plunger abuts on the rocker arm; a pooling chamber that is formed in the plunger and to which the oil is supplied from the oil supply mechanism; a filling chamber that is formed by the plunger and a bottom surface of the body and to which the oil is supplied from the pooling chamber; and a valve body that blocks inflow of the oil from the pooling chamber to the filling chamber when the plunger is put in the body. The control unit stops the oil supply to the pooling chamber by the oil supply mechanism when the exhaust throttle valve is closed.

With the above configuration, even if the closing of the exhaust throttle valve opens the exhaust valve, the oil supply to the pooling chamber in the lash adjuster is stopped. Therefore, the oil supply from the pooling chamber to the filling chamber is also stopped, so that the plunger cannot advance in the direction in which the plunger abuts on the rocker arm. Accordingly, even if the exhaust valve opens with the closing of the exhaust throttle valve, it is hard for the plunger of the lash adjuster to advance.

In the above valve drive system, when the oil temperature of the oil to be supplied to the pooling chamber is lower than a predetermined temperature, the control unit may close the exhaust throttle valve after the control unit stops the oil supply to the pooling chamber.

In the above configuration, when the oil temperature is lower than the predetermined temperature, the viscosity of the oil is high. Therefore, a time is needed after the control unit stops the oil supply to the pooling chamber of the lash adjuster and before the oil pressure within the pooling chamber starts to decrease. In this regard, with the above configuration, the exhaust throttle valve is closed after the stop of the oil supply to the pooling chamber, and therefore, a situation where the exhaust throttle valve is closed before the oil pressure within the pooling chamber starts to decrease is unlikely to occur.

In the above valve drive system, the control unit may calculate a wait time after the control unit stops the oil supply to the lash adjuster when the oil temperature is lower than the predetermined temperature and before the control unit closes the exhaust throttle valve, and the wait time may be set to a longer time as the oil temperature is lower.

The viscosity of the oil is higher as the oil temperature is lower, and therefore, a time before the oil pressure within the pooling chamber starts to decrease is longer as the oil temperature is lower. With the above configuration, when the oil temperature is lower than the predetermined temperature, it is possible to adjust the wait time depending on the degree of difficulty in decrease in the oil pressure within the lash adjuster, and therefore, it is possible to close the exhaust throttle valve at an appropriate timing.

In the above valve drive system, the second end portion of the rocker arm may serve as a lid portion that covers a distal end portion of the plunger. In the above configuration, when the exhaust valve opens with the closing of the exhaust throttle valve, the oil supply to the pooling chamber of the lash adjuster is stopped, and therefore, the plunger does not advance. Therefore, the clearance (gap) between the distal end portion of the plunger and the rocker arm increases. In this state, when the rocker arm is strongly swung by the cam, there is a concern that the position of the rocker arm deviates from the position of the distal end portion of the plunger, so that the rocker arm drops off. With the above configuration, since the lid portion covers the distal end portion of the plunger, there is a high possibility that the distal end portion of the plunger is contained in the interior of the lid portion, even if the rocker arm is somewhat swung. Accordingly, there is a low possibility that the rocker arm drops off.

In the above valve drive system, a recess portion may be recessed toward a central axis of the plunger, on an outer circumference surface of a distal end portion of the plunger, and a protrusion portion may be protruded from the rocker arm, the protrusion portion engaging with the recess portion.

With the above configuration, the protrusion portion of the rocker arm engages with the recess portion of the distal end portion of the plunger, and the protrusion portion holds the plunger. Therefore, even if the rocker arm is strongly swung by the cam, the plunger is swung together with the rocker arm. Accordingly, it is possible to restrain an excessive increase in the clearance between the distal end portion of the plunger and the rocker arm.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein:

FIG. 4 is a graph showing a wait time with respect to an oil temperature;

FIG. 5A is a time chart showing a change in on-off of an exhaust brake;

FIG. 5B is a time chart showing a change in a mode of an oil switch valve; and FIG. 5C is a time chart showing a change in an opening degree of the exhaust throttle valve.

DETAILED DESCRIPTION OF EMBODIMENTS

Figure 1:
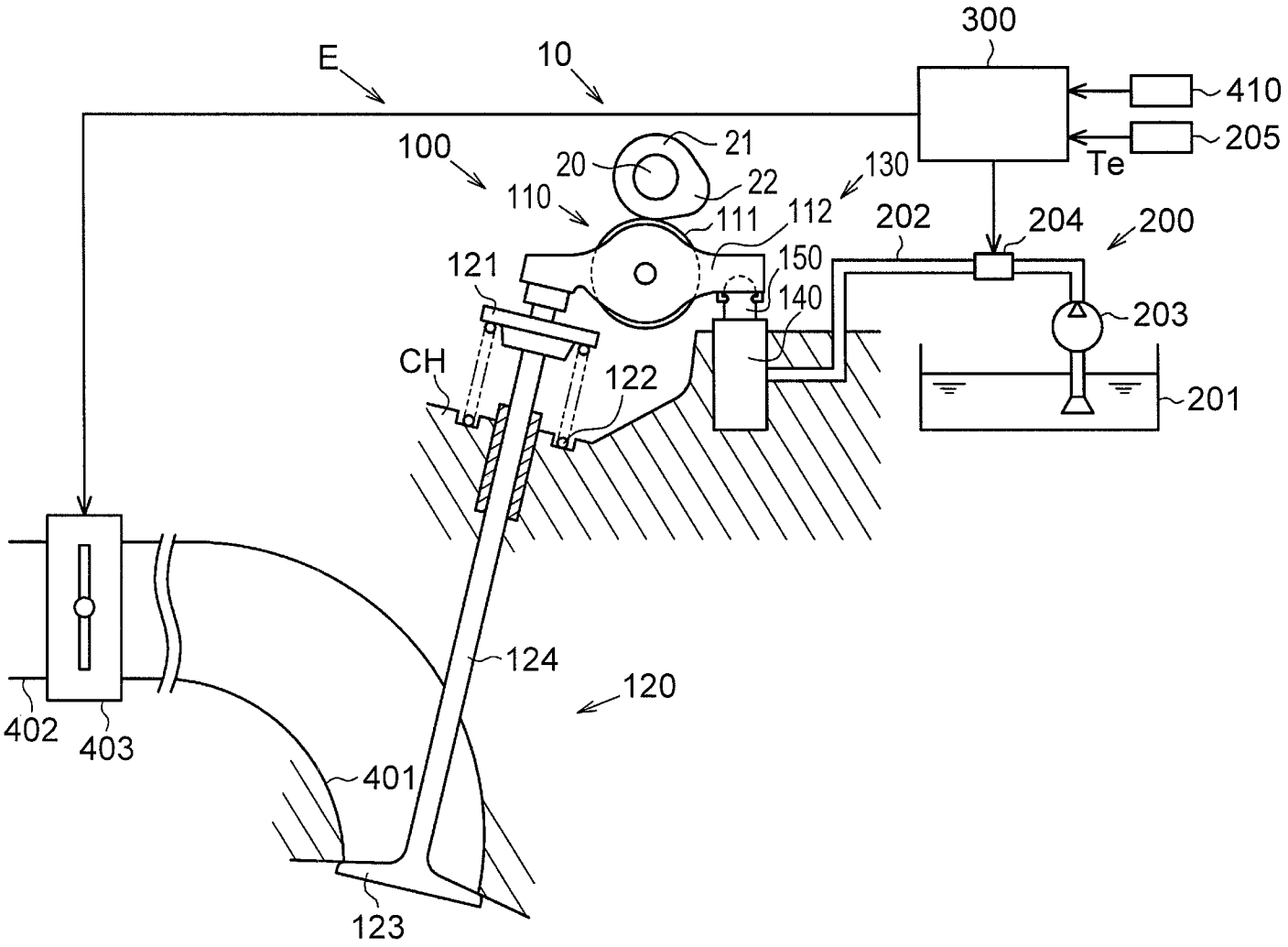
FIG. 1 is a schematic view of a valve drive system of an internal combustion engine.

Hereinafter, an embodiment of a valve drive system of an internal combustion engine will be described with reference to the drawings. As shown in FIG. 1, an internal combustion engine E includes a cylinder head CH in which an exhaust port 401 and an unillustrated intake port are formed. The exhaust port 401 of the cylinder head CH is connected with an exhaust pipe 402 through an unillustrated exhaust manifold. In the exhaust pipe 402, there is attached an exhaust throttle valve 403 that changes a flow passage cross-section area of the exhaust pipe 402.

As shown in FIG. 1, in the cylinder head CH of the internal combustion engine E, there is equipped an exhaust camshaft 20 to which rotation of a crankshaft as an output shaft is transmitted. The exhaust camshaft 20 extends in a cylinder array direction of the internal combustion engine E. To the exhaust camshaft 20, a plurality of exhaust cams 21 is attached. A portion of each exhaust cam 21 in a circumferential direction of the exhaust cam 21 is larger in diameter than the other portion. That is, each exhaust cam 21 has a nose portion 22 that protrudes in a radially outward direction relative to the other portion. FIG. 1 illustrates only one of the exhaust cams 21.

The cylinder head CH of the internal combustion engine E is equipped with a valve drive mechanism 100 that is operated by rotation of the exhaust camshaft 20. The valve drive mechanism 100 includes a rocker arm 110 that is pressed by the exhaust cam 21. An arm portion 112 of the rocker arm 110 has a bar-like shape that is elongated in a direction (a right-left direction in FIG. 1) crossing an extending direction of the exhaust camshaft 20. At a center of the arm portion 112 in a longitudinal direction of the arm portion 112, a roller portion 111 is attached to the arm portion 112, in a rotatable manner. A rotation axis of the roller portion 111 is parallel to a rotation axis of the exhaust camshaft 20. The rocker arm 110 is disposed under the exhaust camshaft 20, such that the roller portion 111 abuts on the exhaust cam 21.

In the cylinder head CH, there is attached an exhaust valve 120 for opening and closing the exhaust port 401 of the cylinder head CH. The exhaust valve 120 includes a disc-like exhaust valve body 123 for opening and closing the exhaust port 401 and a bar-shaped shaft portion 124 that extends from the exhaust valve body 123. The exhaust valve body 123, which is disposed on the cylinder side, opens and closes an opening of the exhaust port 401 from the cylinder side. A portion of the shaft portion 124 on the opposite side of the exhaust valve body 123 (on the upper side) penetrates the cylinder head CH, and reaches a space in which the valve drive mechanism 100 is equipped. The upper end of the shaft portion 124 abuts on a first end portion (a left end portion in FIG. 1) of the rocker arm 110 in the longitudinal direction of the rocker arm 110.

A diameter expansion portion 121 projects from an outer circumference surface at a vicinity of the upper end of the shaft portion 124, in a radially outward direction. A valve spring 122 is interposed between the diameter expansion portion 121 and the cylinder head CH. The valve spring 122 biases the whole of the exhaust valve 120 to the side of the rocker arm 110, through the diameter expansion portion 121. Accordingly, when force does not act from the side of the rocker arm 110, the exhaust valve body 123 of the exhaust valve 120 shuts the exhaust port 401. Further, the first end portion of the rocker arm 110 is pressed to the upper side by the exhaust valve 120, and the rocker arm 110 is biased to the upper side. As a result, the roller portion 111 of the rocker arm 110 abuts on an outer circumference surface of the exhaust cam 21.

In the cylinder head CH, there is attached a lash adjuster 130 for adjusting the gap between the rocker arm 110 and the exhaust valve 120. The lash adjuster 130 includes a bottomed cylinder-like body 140. Into the body 140, a cylinder-like plunger 150 is inserted. The plunger 150 can advance from the body 140 and can be put in the body 140, in a central axis direction of the body 140. A distal end of the plunger 150 on the advance-directional side of the plunger 150 abuts on a second end portion of the rocker arm 110 in the longitudinal direction of the rocker arm 110.

When the exhaust camshaft 20 rotates in a state where the distal end of the plunger 150 abuts on the second end portion of the arm portion 112, the exhaust cam 21 rotates while sliding on the roller portion 111 of the rocker arm 110. Then, when the nose portion 22 of the exhaust cam 21 abuts on the roller portion 111, the rocker arm 110 moves to the lower side against the biasing force of the valve spring 122. At this time, the rocker arm 110 swings while the second end portion supported by the lash adjuster 130 is adopted as a supporting point, such that the first end portion of the rocker arm 110 moves to the lower side. When the rocker arm 110 swings, the exhaust valve 120 is pressed to the rocker arm 110. As a result, the exhaust valve 120 moves to the lower side, and the opening of the exhaust port 401 opens. In this way, based on the operation of the exhaust cam 21 and the rocker arm 110, the exhaust valve 120 reciprocates in the axis direction of the shaft portion 124, and opens and closes the exhaust port 401.

Figure 2:
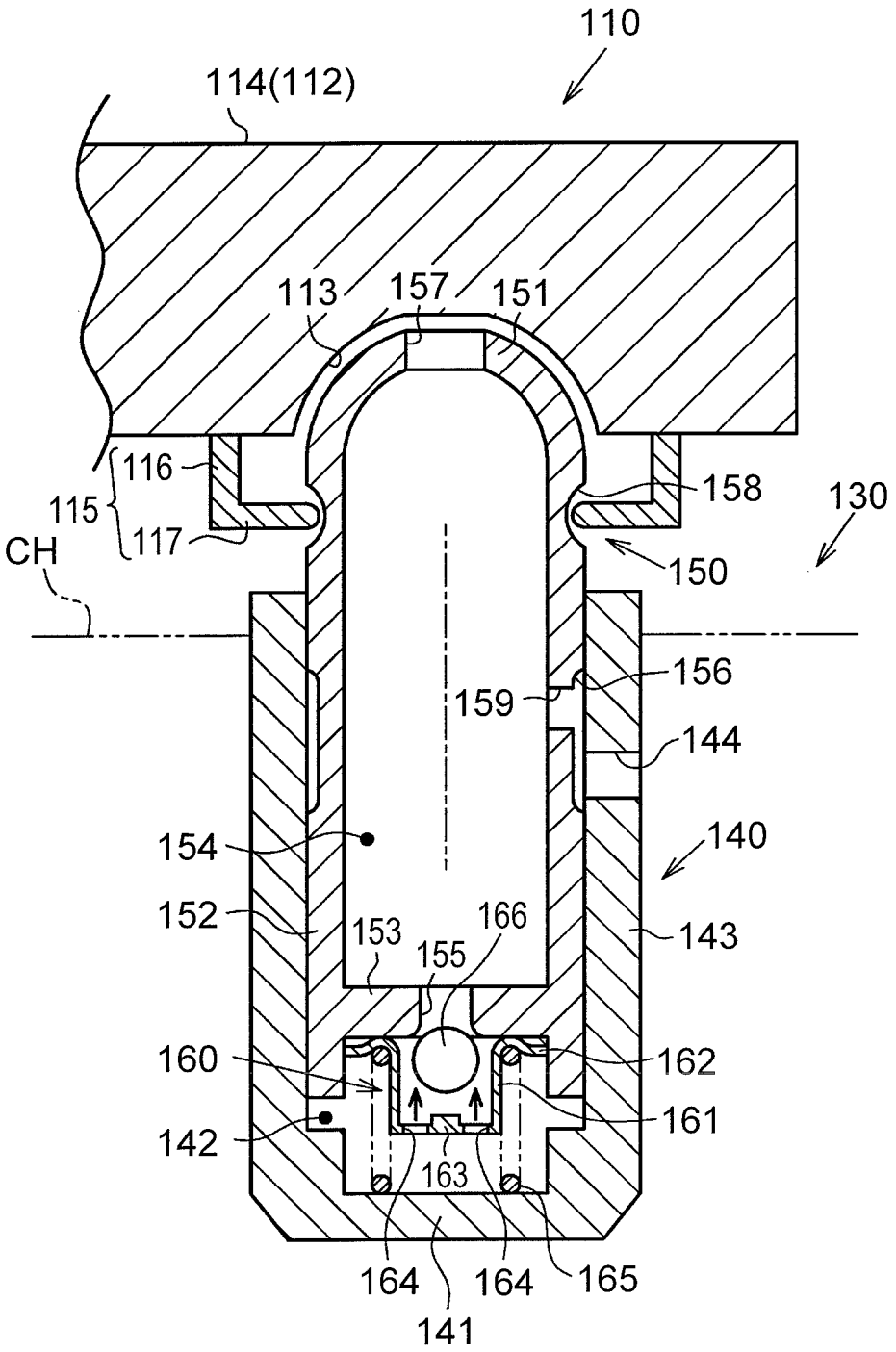
FIG. 2 is a sectional view of a lash adjuster.

Next, the structure of the lash adjuster 130 and the periphery of the valve drive mechanism 100 will be described in detail. As shown in FIG. 2, the lash adjuster 130 includes the bottomed cylinder-like body 140. A body introduction hole 144 passes through a circumferential wall 143 of the body 140, in a radial direction of the body 140. The cylinder-like plunger 150 is inserted into the body 140. The outer diameter of the plunger 150 is slightly smaller than the inner diameter of the body 140, and the plunger 150 can advance from the body 140 and can be put in the body 140, in the axis direction. The size of the plunger 150 in the axis direction is larger than the size of the body 140 in the axis direction. That is, a portion of the plunger 150 on the distal end side of the plunger 150 protrudes from the body 140. An end portion of the plunger 150 on a side where the plunger 150 abuts on the rocker arm 110, that is, a distal end portion 151 of the plunger 150 has a hemispherical shape.

On the outer circumference surface of a circumferential wall 152 of the plunger 150, there is a concave portion 156 where the outer circumference surface is dented in a radially inward direction of the plunger 150. On the concave portion 156, the circumferential wall 152 of the plunger 150 is dented over the whole circumference. The size of the concave portion 156 in the axis direction is set such that the concave portion 156 communicates with the body introduction hole 144 even if the plunger 150 maximally advances from the body 140. A plunger through-hole 159 passes through a bottom surface (a surface on the radially inward side of the plunger 150) of the concave portion 156, in a radial direction of the plunger 150.

A through-hole 157 passes through the distal end portion 151 of the plunger 150, in the radial direction of the plunger 150. On the outer circumference surface of the distal end portion 151 of the plunger 150, a recess portion 158 is recessed in the radially inward direction of the plunger 150.

In the interior of the plunger 150, there is provided a partition wall 153 that partitions the internal space of the plunger 150 into two spaces in the axis direction. The partition wall 153 is positioned so as to be closer to a base end side (the opposite side of the distal end) in the axis direction of the plunger 150, than the plunger through-hole 159 is. The partition wall 153 has a plate shape that extends in a direction orthogonal to the axis direction of the plunger 150.

In the interior of the plunger 150, a pooling chamber 154 is formed by the circumferential wall 152 and partition wall 153 of the plunger 150. Further, between the plunger 150 and the body 140, a filling chamber 142 is formed by the partition wall 153 of the plunger 150, a circumferential wall 143 of the body 140 and a bottom wall 141 of the body 140. Further, a valve hole 155 that communicates with the pooling chamber 154 and the filling chamber 142 passes through the center of the partition wall 153.

In the filling chamber 142, a bottomed cylinder-like retainer 160 is provided. The retainer 160 is constituted by a cylinder portion 161 that has a bottomed cylindrical shape and a flange portion 162 that projects from an opening rim of the cylinder portion 161 in the radially outward direction. The flange portion 162 of the retainer 160 abuts on the partition wall 153 around the valve hole 155.

In the filling chamber 142, a coil spring 165 is interposed between the flange portion 162 of the retainer 160 and the bottom wall 141 of the body 140. Biasing force of the coil spring 165 is transmitted to the plunger 150 through the flange portion 162 of the retainer 160. Thereby, the plunger 150 is constantly biased in the axis direction, specifically, in a direction in which the plunger 150 advances from the body 140.

The cylinder portion 161 of the retainer 160 contains a valve body 166 that can shut the valve hole 155. The valve body 166 has a spherical shape with a larger diameter than the diameter of the valve hole 155. Further, a hole 164 passes through a bottom portion 163 of the cylinder portion 161 of the retainer 160, and provides communication between the interior and exterior of the retainer 160.

The second end portion of the arm portion 112 of the rocker arm 110 is placed on the distal end portion 151 of the plunger 150 of the lash adjuster 130. The second end portion of the arm portion 112 of the rocker arm 110 has a concave portion 113 where the second end portion is dented in the direction of the advance of the plunger 150. The concave portion 113 has a hemispherical shape similar to the shape of the distal end portion 151 of the plunger 150. The inner surface of the concave portion 113 abuts on the distal end portion 151 of the plunger 150. Thus, the second end portion of the arm portion 112 of the rocker arm 110 functions as a lid portion 114 that covers the through-hole 157 of the distal end portion 151 of the plunger 150. In a state where the distal end portion 151 of the plunger 150 fits in the concave portion 113 of the lid portion 114, the through-hole 157 of the plunger 150 is shut by the inner surface of the concave portion 113.

A pair of protrusion portions 115 is protruded from both sides of the concave portion 113 of the lid portion 114 of the rocker arm 110. Connection portions 116 of the protrusion portions 115 extend toward the cylinder head CH side. Engagement portions 117 of the protrusion portions 115 extend from lower end portions of the connection portions 116 toward the plunger 150 side. Distal end portions of the engagement portions 117 are positioned in the recess portion 158 of the plunger 150. That is, distal ends of the protrusion portions 115 (the engagement portions 117) engage with the distal end portion 151 of the plunger 150.

Next, an oil supply mechanism 200 that supplies oil to the lash adjuster 130 of the valve drive mechanism 100 will be described. As shown in FIG. 1, the oil supply mechanism 200 of the internal combustion engine E includes an oil pan 201 in which the oil is pooled, an oil supply passage 202 that is a flow passage for the oil, an oil pump 203 that feeds the oil by pressure, and an oil switch valve 204. The oil pan 201 of the oil supply mechanism 200 is connected with one end of the oil supply passage 202. The other end of the oil supply passage 202 is connected with the body introduction hole 144 of the body 140 of the lash adjuster 130. The oil supply passage 202 branches in the middle, and is connected with spots of the internal combustion engine E that require lubrication or cooling, although the illustration is omitted.

The oil pump 203 is equipped in the middle of the oil supply passage 202. The oil pump 203 sucks the oil from the oil pan 201, and feeds the oil to the lower side of the oil supply passage 202 by pressure.

The oil switch valve 204 is attached to the oil supply passage 202, downstream of the oil pump 203. The oil switch valve 204 can open and close the oil supply passage 202. When the oil switch valve 204 opens, the supply of the oil from the oil pump 203 to the lash adjuster 130 is permitted. When the oil switch valve 204 closes, the supply of the oil from the oil pump 203 to the lash adjuster 130 is stopped. Further, an oil temperature sensor 205 is provided in the middle of the oil supply passage 202. The oil temperature sensor 205 measures an oil temperature Te of the oil that is supplied to the lash adjuster 130.

Next, a control unit 300 of the valve drive system 10 will be described. The control unit 300 controls the exhaust throttle valve 403 provided in the exhaust pipe 402 of the internal combustion engine E and the oil switch valve 204 provided in the oil supply mechanism 200.

The control unit 300 is configured as a computer including an arithmetic unit, a storage unit (memory) and the like. The control unit 300 receives a signal from an exhaust brake switch 410. The exhaust brake switch 410 is equipped at the periphery of a driver's seat of a vehicle, and a driver of the vehicle turns the exhaust brake switch 410 on when actuating an exhaust brake. Further, the control unit 300 receives a signal indicating the oil temperature Te measured by the oil temperature sensor 205.

The control unit 300 outputs a control signal for the exhaust throttle valve 403 and a control signal for the oil switch valve 204, based on the signal from the exhaust brake switch 410 and the signal from the oil temperature sensor 205. In the embodiment, when the exhaust brake switch 410 is turned on by the driver, the control unit 300 closes the oil switch valve 204, and stops the oil supply to the pooling chamber 154 of the lash adjuster 130. Thereafter, the control unit 300 closes the exhaust throttle valve 403.

Next, a control for the exhaust throttle valve 403 and the oil switch valve 204 that is performed by the control unit 300, particularly, an opening-closing control for the exhaust throttle valve 403 and the oil switch valve 204 when the exhaust brake is used will be described with reference to FIG. 3.

When the driver turns on the exhaust brake switch 410 for actuating the exhaust brake and the control unit 300 receives a signal indicating the driver's operation from the exhaust brake switch 410, the control unit 300 executes a process of step S11 in the opening-closing control for the exhaust throttle valve 403 and the oil switch valve 204.

In step S11, the control unit 300 switches the oil switch valve 204 to a discharge mode. Specifically, the control unit 300 closes the oil switch valve 204. In a state where the oil switch valve 204 is closed, the oil supply to the pooling chamber 154 of the lash adjuster 130 is stopped. On the other hand, the oil in the pooling chamber 154 can be discharged from the through-hole 157 of the plunger 150, and therefore, the oil pressure within the pooling chamber 154 decreases. After the control unit 300 closes the oil switch valve 204, the control unit 300 transfers the process to step S12.

In step S12, the control unit 300 determines whether the oil temperature Te is lower than a predetermined temperature Tlim. Specifically, in the case where the oil temperature Te input from the oil temperature sensor 205 to the control unit 300 indicates an oil temperature Te lower than the predetermined temperature Tlim, the control unit 300 determines that the oil temperature Te is lower than the predetermined temperature Tlim. For example, the predetermined temperature Tlim is −10° C. In the case where the control unit 300 determines that the oil temperature Te is equal to or higher than the predetermined temperature Tlim in step S12 (S12: NO), the control unit 300 transfers the process to step S21. In step S21, the control unit 300 sets a wait time TW to zero, regardless of the oil temperature Te. Thereafter, the control unit 300 transfers the process to step S14.

On the other hand, in the case where the control unit 300 determines that the oil temperature Te is lower than the predetermined temperature Tlim in step S12 (S12: YES), the control unit 300 transfers the process to step S13. In step S13, the control unit 300 calculates the wait time TW after the stop of the oil supply to the lash adjuster 130 and before the closing of the exhaust throttle valve 403. Specifically, as shown in FIG. 4, based on the oil temperature Te input to the control unit 300, the control unit 300 sets the wait time TW to a longer time as the oil temperature Te is lower. A relational expression, a map or the like indicating the wait time TW with respect to the oil temperature Te is previously stored in the storage unit of the control unit 300. The relational expression, the map or the like is created by previously performing a test, a simulation or the like. Thereafter, the control unit 300 transfers the process to step S14.

Figure 3:
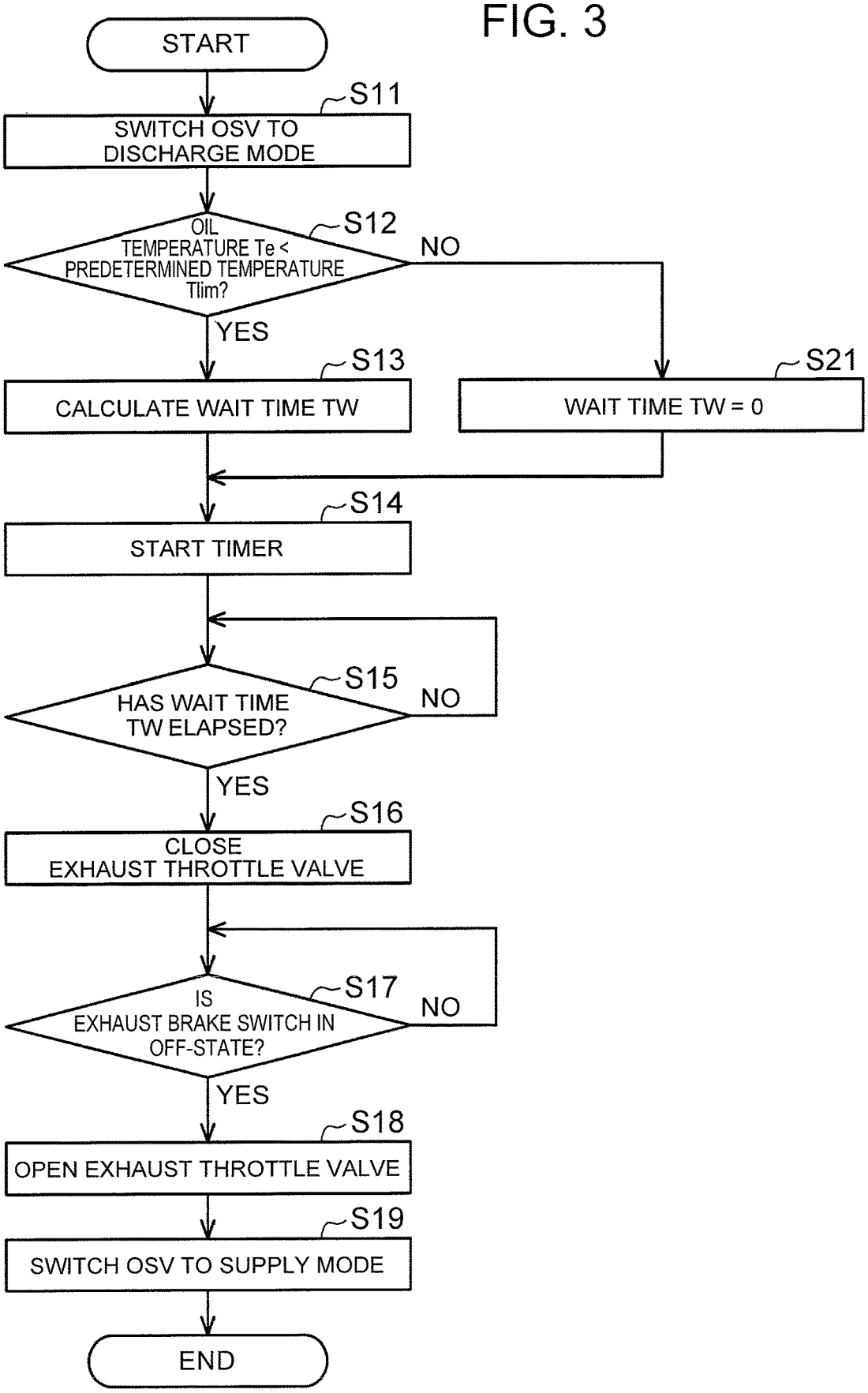
FIG. 3 is a flowchart showing an opening-closing process of an exhaust throttle valve.

As shown in FIG. 3, in step S14, the control unit 300 starts the timer. Thereafter, the control unit 300 transfers the process to step S15. In step S15, the control unit 300 determines whether the set wait time TW has elapsed since the start of the timer. In the case where the control unit 300 determines that the wait time TW has not elapsed in step S15 (S15: NO), the control unit 300 repeats the process of step S15. On the other hand, in the case where the control unit 300 determines that the wait time TW has elapsed in step S15 (S15: YES), the control unit 300 transfers the process to step S16.

In step S16, the control unit 300 closes the exhaust throttle valve 403. The closing of the exhaust throttle valve 403 decreases the flow passage cross-section area of the exhaust pipe 402 of the internal combustion engine E. Thereby, exhaust pressure increases, and the vehicle is decelerated by the exhaust brake. After the control unit 300 closes the exhaust throttle valve 403, the control unit 300 transfers the process to step S17.

In step S17, the control unit 300 determines whether the exhaust brake switch 410 is in an off-state. Specifically, when the driver turns off the exhaust brake switch 410 and the control unit 300 receives a signal indicating the driver's operation from the exhaust brake switch 410, the control unit 300 determines that the exhaust brake switch 410 is in the off-state. In the case where the control unit 300 determines that the exhaust brake switch 410 is not in the off-state in step S17 (S17: NO), the control unit 300 repeats the process of step S17. On the other hand, in the case where the control unit 300 determines that the exhaust brake switch 410 is in the off-state in step S17 (S17: YES), the control unit 300 transfers the process to step S18.

In step S18, the control unit 300 opens the exhaust throttle valve 403. The opening of the exhaust throttle valve 403 increases the flow passage cross-section area of the exhaust pipe 402 of the internal combustion engine E. Thereby, the action of the exhaust brake stops. Thereafter, the control unit 300 transfers the process to step S19.

In step S19, the control unit 300 switches the oil switch valve 204 to a supply mode. Specifically, the control unit 300 opens the oil switch valve 204. By the opening of the oil switch valve 204, the oil supply to the pooling chamber 154 of the lash adjuster 130 is restarted. Thereafter, the control unit 300 ends the opening-closing process for the exhaust throttle valve 403 and the oil switch valve 204.

Next, an operation and an effect of the valve drive system 10 in the embodiment will be described. As shown in FIG. 5A to FIG. 5C, before time t1, the exhaust brake switch 410 is in the off-state, the oil switch valve 204 is in the supply mode, and the exhaust throttle valve 403 is in the open state. In this case, the oil switch valve 204 has been opened, and therefore, the oil is being supplied to the pooling chamber 154 of the plunger 150 of the lash adjuster 130. Therefore, in a situation where there is a clearance between the rocker arm 110 and the plunger 150, the plunger 150 starts to advance from the interior of the body 140, by the biasing force of the coil spring 165. On this occasion, the volume of the filling chamber 142 starts to increase, and as a result, the oil pressure of the filling chamber 142 decreases. Then, since the oil is being supplied to the pooling chamber 154, when the oil pressure of the pooling chamber 154 becomes higher than the oil pressure of the filling chamber 142, the valve body 166 is opened, and the oil flows from the pooling chamber 154 into the filling chamber 142. Thereby, the plunger 150 advances from the interior of the body 140, so that the clearance between the rocker arm 110 and the plunger 150 is eliminated.

At time t1, as shown in FIG. 5A, the exhaust brake switch 410 is switched from OFF to ON, and as shown in FIG. 5B, the oil switch valve 204 is switched to the discharge mode. In this case, the oil switch valve 204 is closed, and the output of the oil from the oil pump 203 to the oil supply passage 202 is restricted. Therefore, the oil supply to the lash adjuster 130 is stopped, and the oil in the lash adjuster 130 can be discharged to the exterior of the lash adjuster 130, through the through-hole 157 of the plunger 150 and the interval between the plunger 150 and the body 140. Therefore, the oil pressure within the filling chamber 142 is higher than the oil pressure within the pooling chamber 154, and the valve body 166 has been closed. In this state, the oil cannot flow into the filling chamber 142, and it is hard for the volume of the filling chamber 142 to change. Therefore, even if the rocker arm 110 departs from the plunger 150, it is hard for the plunger 150 to advance.

Thereafter, as shown in FIG. 5C, at time t2 when the wait time TW has elapsed from time t1, the exhaust throttle valve 403 is closed. Therefore, there is a concern that the exhaust pressure within the exhaust port 401 becomes high and the exhaust valve 120 is opened. When the exhaust valve 120 is opened, an unintentional clearance is produced between the lid portion 114 of the rocker arm 110 and the plunger 150. However, the oil switch valve 204 is set to the discharge mode, at time t1 before time t2. Therefore, even if the unintentional clearance is produced due to the exhaust brake as described above, it is possible to restrain the plunger 150 from advancing from the interior of the body 140.

As the oil temperature Te is lower, the viscosity of the oil is higher, and therefore, the time before the oil pressure within the pooling chamber 154 starts to decrease is longer. In the embodiment, in the case where the oil temperature Te is lower than the predetermined temperature Tlim, the exhaust throttle valve 403 is closed at time t2 when the wait time TW has elapsed from time t1. The wait time TW is set to a longer time as the oil temperature Te is lower. Therefore, depending on the degree of difficulty in decrease in the oil pressure within the pooling chamber 154, it is possible to restrain the exhaust throttle valve 403 from being closed before the oil pressure within the pooling chamber 154 starts to decrease, and it is possible to close the exhaust throttle valve 403 at an appropriate timing.

From time t2 to time t3, the oil is not supplied to the pooling chamber 154, and therefore, the plunger 150 does not advance from the body 140. Therefore, when the exhaust valve 120 unintentionally opens, as described above, the clearance between the rocker arm 110 and the plunger 150 increases. When the rocker arm 110, in this state, is repeatedly pressed by the nose portion 22 of the exhaust cam 21 with the rotation of the exhaust camshaft 20, there is a possibility that the rocker arm 110 is diddled on the lash adjuster 130, so that the rocker arm 110 drops from the lash adjuster 130. Even in this case, in the embodiment, the distal end portion 151 of the plunger 150 is contained in the interior of the concave portion 156 of the rocker arm 110. Therefore, even if the rocker arm 110 is somewhat diddled, there is a low possibility that the distal end portion 151 of the plunger 150 of the lash adjuster 130 moves out of the concave portion 156 of the rocker arm 110. Furthermore, in the embodiment, the protrusion portion 115 of the lid portion 114 engages with the recess portion 158 at the distal end portion 151 of the plunger 150. Since the lid portion 114 holds the plunger 150 in this way, even if the rocker arm 110 is strongly swung by the exhaust cam 21, it is possible to prevent the drop of the rocker arm 110 due to an excessive increase in the clearance between the lid portion 114 of the rocker arm 110 and the plunger 150.

At time t3, as shown in FIG. 5A, the exhaust brake switch 410 is switched to OFF, and as shown in FIG. 5B, the oil switch valve 204 is switched to the supply mode. Furthermore, as shown in FIG. 5C, the exhaust throttle valve 403 is opened. Thereby, the state after time t3 becomes the same as the state before time t1. Therefore, in a situation where there is a clearance between the rocker arm 110 and the plunger 150, the clearance can be eliminated.

The above embodiment can be carried out while being modified as follows. The above embodiment and the following modifications can be carried out while being combined with each other, as long as there is no technical inconsistency.

Even if the oil temperature Te is lower than the predetermined temperature Tlim, the control unit 300 may set the wait time TW to a constant wait time TW regardless of the oil temperature Te. For example, the constant wait time TW may be a time in which the oil pressure within the pooling chamber 154 starts to decrease even at the lowest possible oil temperature Te.

The timing of the closing of the exhaust throttle valve 403 is not limited to a timing after the oil switch valve 204 is switched to the discharge mode. For example, the control unit 300 may close the exhaust throttle valve 403, at the same time as the time when the control unit 300 switches the oil switch valve 204 to the discharge mode.

When the oil temperature Te is equal to or higher than the predetermined temperature Tlim, the wait time TW may be set to a value other than zero. For example, when the oil temperature Te is equal to or higher than the predetermined temperature Tlim, the exhaust throttle valve 403 may be closed after elapse of the wait time TW, in consideration of the time before the oil pressure within the pooling chamber 154 starts to decrease. In this case, the wait time TW may be constant, or may be set to a longer time as the oil temperature is lower.

The predetermined temperature Tlim may be higher than −10° C., or may be lower than −10° C. For example, in consideration of physical properties and the like of the oil, the predetermined temperature Tlim may be set to a lower limit that requires the wait time TW before the oil pressure of the pooling chamber 154 starts to decrease.

The disclosure is not limited to a configuration in which a portion of the arm portion 112 of the rocker arm 110 functions as the lid portion 114, and another member that functions as a lid portion may be attached to the arm portion 112. A dome-shaped plunger receiving member may be attached to the arm portion 112 of the rocker arm 110, and the plunger receiving member may function as the lid portion 114 of the rocker arm 110.

The second end portion of the rocker arm 110 does not need to configure the lid portion 114. For example, the second end portion of the rocker arm 110 may merely abut on the distal end portion 151 of the plunger 150.

The configuration of the protrusion portions 115 of the rocker arm 110 is not limited to the configuration in the embodiment. For example, the number of the protrusion portions 115 may be one or may be three or more. Further, the protrusion portions 115 may engage with the recess portion 158 at the distal end portion 151 of the plunger 150, over the whole in the circumferential direction.

It is not necessary to include the recess portion 158 at the distal end portion 151 of the plunger 150 and the protrusion portions 115 of the rocker arm 110. Even in the case of excluding the recess portion 158 and the protrusion portions 115, it is possible to prevent the drop of the rocker arm 110, because the distal end portion 151 of the plunger 150 of the lash adjuster 130 is positioned in the concave portion 156 of the lid portion 114.

The disclosure is not limited to a configuration in which the oil temperature Te is measured by the oil temperature sensor 205. For example, the oil temperature Te may be a temperature that is estimated from the temperature of the oil supply passage 202 or the temperature of coolant for the internal combustion engine E.

The wait time TW may be calculated based on the viscosity of the oil. For example, since a high viscosity of the oil increases the load on the oil pump 203, the viscosity of the oil may be estimated from the amount of the load on the oil pump 203, and the wait time TW may be calculated from the estimated oil viscosity.

The configuration of the oil supply mechanism 200 is not limited to the configuration in the embodiment. The oil supply mechanism 200 only needs to be at least a mechanism that supplies the oil to the lash adjuster 130 and stops the supply of the oil.

What is claimed is:

1. A valve drive system of an internal combustion engine, comprising:

a rocker arm that is swung by a cam;

an exhaust valve that abuts on a first end portion of the rocker arm and that is opened and closed by the rocker arm;

a lash adjuster that supports a second end portion of the rocker arm;

an oil supply mechanism that supplies oil to the lash adjuster; and a control unit that controls an exhaust throttle valve and that controls the oil supply mechanism, the exhaust throttle valve changing a flow passage cross-section area of an exhaust pipe of the internal combustion engine, wherein the lash adjuster including:

a bottomed cylindrical body;

a plunger that is contained in the body and that is biased in a direction in which the plunger abuts on the rocker arm;

a pooling chamber that is formed in the plunger and to which the oil is supplied from the oil supply mechanism;

a filling chamber that is formed by the plunger and a bottom surface of the body and to which the oil is supplied from the pooling chamber; and a valve body that blocks inflow of the oil from the pooling chamber to the filling chamber when the plunger is put in the body, and wherein the control unit stopping the oil supply to the pooling chamber by the oil supply mechanism when the exhaust throttle valve is closed.

2. The valve drive system of the internal combustion engine according to claim 1, wherein when an oil temperature of the oil to be supplied to the pooling chamber is lower than a predetermined temperature, the control unit closes the exhaust throttle valve after the control unit stops the oil supply to the pooling chamber.

3. The valve drive system of the internal combustion engine according to claim 2, wherein the control unit calculates a wait time after the control unit stops the oil supply to the lash adjuster when the oil temperature is lower than the predetermined temperature and before the control unit closes the exhaust throttle valve, and the wait time is set to a longer time as the oil temperature is lower.

4. The valve drive system of the internal combustion engine according to claim 1, wherein the second end portion of the rocker arm serves as a lid portion that covers a distal end portion of the plunger.

5. The valve drive system of the internal combustion engine according to claim 1, wherein:

a recess portion is recessed toward a central axis of the plunger, on an outer circumference surface of a distal end portion of the plunger; and a protrusion portion is protruded from the rocker arm, the protrusion portion engaging with the recess portion.

* * * * *